US005369822A

United States Patent [19]

Dennison

[11] Patent Number: 5,369,822

[45] Date of Patent: Dec. 6, 1994

[54] BENT WIRE SPRING MODULE

[75] Inventor: Timothy D. Dennison, Carthage, Mo.

[73] Assignee: Leggett & Platt Incorporated, Carthage, Mo.

[21] Appl. No.: 4,534

[22] Filed: Jan. 14, 1993

[51] Int. Cl.[5] ..... F16F 3/00; A47C 23/00

[52] U.S. Cl. ..... 5/247; 5/255; 267/103

[58] Field of Search ..... 5/247, 255, 263, 267; 267/103, 101

[56] References Cited

U.S. PATENT DOCUMENTS

| | | | |
|---|---|---|---|
| 4,577,841 | 3/1986 | Hagemeister | 5/247 |
| 4,595,181 | 6/1986 | Hagemeister | 5/247 |
| 4,828,233 | 5/1989 | Hagemeister | 5/248 |
| 4,896,386 | 1/1990 | Ogle et al. | 5/247 |
| 4,932,535 | 6/1990 | Dabney | 5/247 |
| 5,142,715 | 9/1992 | Ogle et al. | 5/247 |

*Primary Examiner*—Alexander Grosz
*Attorney, Agent, or Firm*—Wood, Herron & Evans

[57] ABSTRACT

A bent wire spring unit having a spaced pair of foot portions and a spring member extending upwardly from each foot portion. Each spring member is formed of a series of torsion bars and connector bars interconnected by bends in the spring wire. The spring members are connected at their upper ends by a locking member or portion having first and second pairs of bends in the spring wire and two locking bars extending from the second pair of bends. The locking bars are linear segments of wire angled downwardly such that they converge into a connecting bend. The locking bars and the connecting bend lie in a single plane and the distal ends of the locking bars and the connecting bend extend significantly below an uppermost torsion member of each spring member. A spring assembly is disclosed which includes the bent wire spring unit attached to a wire grid at its upper end and a base frame at its lower end. The spring unit is locked onto the wire grid by attaching the locking member to a wire in the wire grid such that the wire is contained in the second pair of bends.

20 Claims, 3 Drawing Sheets

BENT WIRE SPRING MODULE

BACKGROUND OF THE INVENTION

The present invention generally relates to mattress foundation structures and more particularly to a non-coil spring and spring assembly used in a box spring structure.

A variety of bent wire springs or so called modular springs have been developed to replace coil springs in box spring assemblies in which a grid frame is connected to a rigid base frame. Such box spring assemblies are commonly used for supporting mattresses. Bent wire springs have certain advantages over conventional coil springs as they provide a desirably stiff foundation, contain a reduced amount of wire, have a prolonged service life and are easier and less costly to manufacture.

One prior bent wire spring module over which the present invention is an improvement is disclosed by Hagemeister in U.S. Pat. No. 4,828,233. This patent discloses a bent wire spring module having means for locking the upper end of the spring to a grid wire without the need for fasteners such as sheet metal clips and without the need for forming deviations in the grid wires as was common practice in the prior art. The locking means disclosed in this Hagemeister patent includes support wires each being connected to downwardly angled locking wires by a curved connecting portion in the wire. The distal ends of the locking wires are connected by a curved portion which is angled upwardly with respect to the locking wires. The modular bent wire spring is placed over a wire of the wire grid such that an inside surface of the curved connecting portion abuts against the grid wire.

Although the bent wire spring module of Hagemeister has been an improvement over past designs of such springs, design features are contemplated in the present invention which improve manufacturing efficiency and facilitate easy assembly of the modules with a wire grid.

Accordingly, it has been one object of the invention to provide a bent wire spring module having a locking mechanism which eliminates the need for forming deviations in the grid wires or using separate fasteners but also significantly improves manufacturing efficiency associated with the module.

It has been another objective of the invention to provide a bent wire spring module which is easier to assemble into a spring assembly.

SUMMARY OF THE INVENTION

To these ends, a preferred embodiment of the present invention takes the form of an integrally formed bent wire spring unit or module and a spring assembly incorporating the module. The bent wire spring module includes two feet connected to an upper locking portion by a pair of intermediate spring portions or members consisting of a plurality of interconnected torsion bars and connector bars. The two feet are preferably made up of a plurality of linear segments bent at approximately 90° to each other. The linear segments are all contained in a single plane such that they may be placed on and attached to a support surface such as the lower base frame of a box spring assembly. Each foot portion has a linear segment thereof which forms the lowermost torsion member of the spring member extending upwardly from the foot portion.

Each spring member or portion of the spring module is formed by linear segments of the wire separated by bends in the spring wire that cause selected linear segments to experience a torsional force during compression of the spring module. The linear segments alternate between torsion members which experience the torsional force and connector members which generally do not bend during compression of the spring module. The specific number of torsion members and connector members in each spring portion depends on the desired height and spring characteristics of the spring. The uppermost and lowermost linear segments of each spring portion are preferably both torsion members.

A locking member or portion is formed at the upper end of the module by specifically oriented bends in the spring wire. A first pair of bends are made at the inner ends of the uppermost torsion members of each spring portion. These bends are oriented in an upward direction with respect to the plane of the foot portions. A straight, upwardly angled segment of the locking member follows each bend of the first pair of bends and leads to a second pair of bends which are downwardly oriented with respect to the plane of the foot portions. A linear segment of wire or locking bar extends from each bend of the second pair of bends. The locking bars preferably converge toward each other and are attached at their distal ends by a connecting bend in the wire. Further, the locking bars preferably extend below the uppermost torsion members of each spring portion or member of the spring unit or module. The locking bars and the connecting bend all lie in the same plane. A wire from a wire grid is locked in place by being located beneath the locking bars and within the second pair of bends.

A spring assembly is formed by attaching a plurality of spring units or modules between upper and lower support structures. The upper support structure takes the form of a wire grid having grid wires which preferably intersect each other at 90° angles and are connected to each other at their intersections. As previously mentioned, the spring units are connected to grid wires by locking the grid wire in place within the second pair of bends in the locking member of the spring unit. The spring units are attached at their lower ends to a base frame, which may, for example, be constructed of wood, by rigidly securing the foot portions to the frame members with suitable conventional fasteners. The specific number and arrangement of spring units or modules contained in the spring assembly may, of course, vary according to the spring characteristics desired in the spring assembly.

Various other aspects and advantages of the invention will be readily apparent to those of ordinary skill in the art from the following detailed description taken in conjunction with the accompanying drawings.

DETAILED DESCRIPTION OF THE PREFERRED EMBODIMENT

Figure 2:
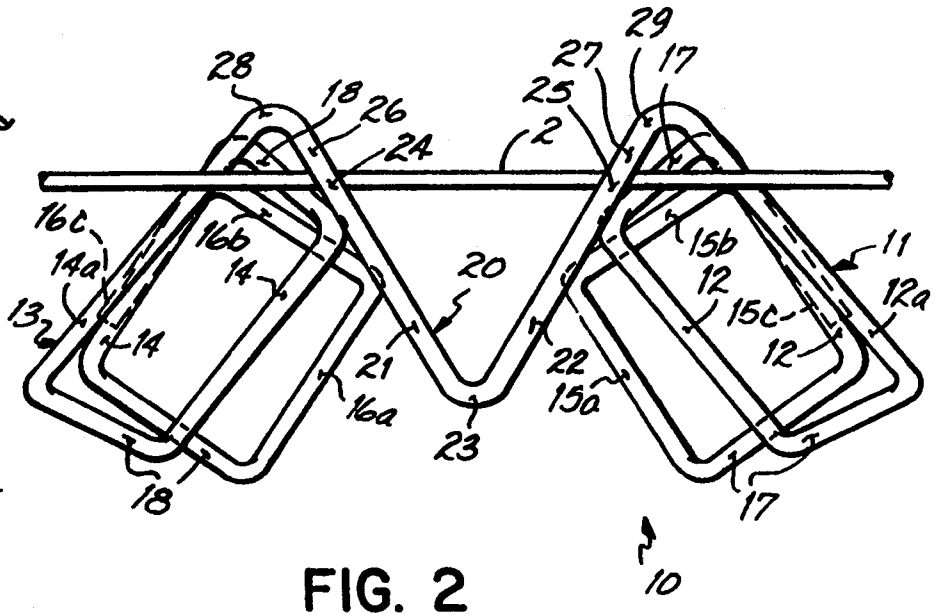
FIG. 2 is a top view of the spring unit with a grid wire locked in place in the locking member of the spring unit.
Figure 1:
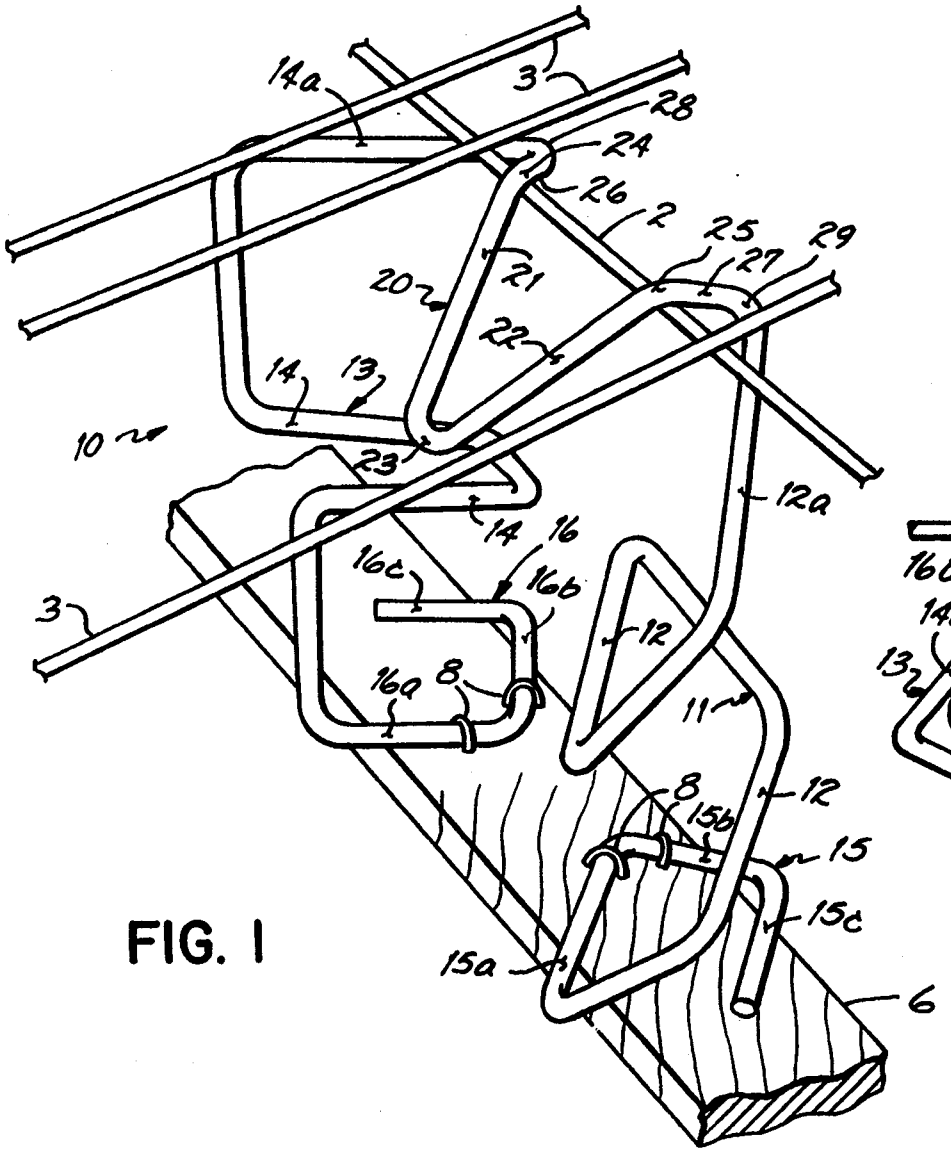
FIG. 1 a perspective view of the spring unit of the invention attached to an upper wire grid network and a lower frame member.

FIG. 1 shows a spring unit or module 10 of the invention attached at an upper end to a grid wire 2 and at a lower end to an inner frame member 6 of a base frame. The wire grid may take the form of a conventional grid used in box spring assemblies and incorporating a set of cross wires 2 and a set of longwires 3. The grid wires 2 of the first set intersect the grid wires 3 of the second set at 90° angles and are welded together at their intersections.

As also shown in FIG. 1, the major components of the spring unit 10 include two lower foot portions 15, 16 and an upper locking member or portion 20 connected to the foot portions 15, 16 by two intermediate spring portions or members 11, 13. The spring unit 10 is connected to a cross wire 2 at a locking portion or member 20 located at the upper end of the spring unit 10. The foot portions 15 and 16 have respective linear segments **15*a*, 15*b*, 15*c* and 16*a*, 16*b*, 16*c* separated by bends in the wire, Linear segments 15*a*, 15*b* and 16*a*, 16*b* are secured by conventional staples 8 to a lower wooden frame member 6**.

The spring members 11, 13 include a plurality of connector bars 17 and 18 and torsion bars **12, 12*a* and 14, 14*a*, respectively. In addition, the foot portions 15, 16 include respective segments 15*a*, 16*a* which form lowermost torsion bars of the spring members 11, 13. The resilience of the spring unit 10 is thus created by the torsion bars 12, 12*a*, 15*a* and 14, 14*a*, 16*a* resiliently deflecting under a torsional force during compression of the spring unit 10. The uppermost torsion bars 12*a*, 14*a* are connected to outer ends of the locking member 20 at a first pair of bends 28, 29. (See FIG. 3). As shown in FIG. 1, spring members or portions 11, 13 each include a lowermost torsion member being segments 15*a*, 16*a* which form part of the respective foot portions 15, 16**. The torsion members on a given spring member are oriented generally parallel to each other and the connecting members on a given spring member are oriented so that connector members extending from opposite ends of a torsion member are oriented transverse to each other.

Figure 3:
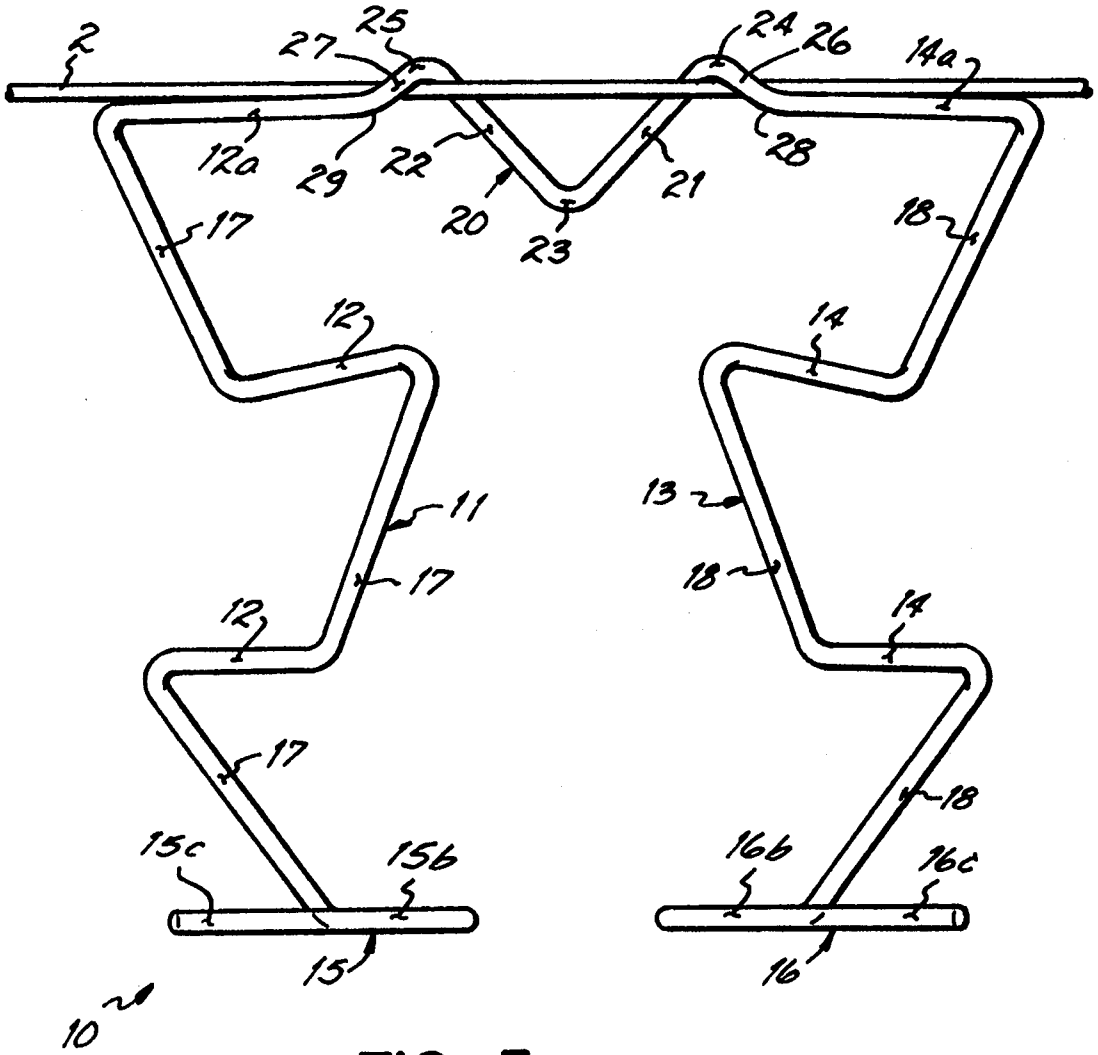
FIG. 3 is a rear elevational view of the spring unit with a grid wire locked in place in the locking member of the spring unit.

Turning now to FIG. 3, the locking member or portion 20 of the spring unit 10 includes outer straight, upwardly angled segments 26, 27 which begin at bends 28, 29 located at the inner ends of the uppermost torsion members **12*a*, 14*a*. The straight, upwardly angled segments 26, 27 end at a second pair of bends 24, 25 where the spring wire angles abruptly in a downward direction into linear locking bars 21, 22. The locking bars 21, 22 converge and are connected at a connecting bend 23** located at their distal ends.

Figure 4:
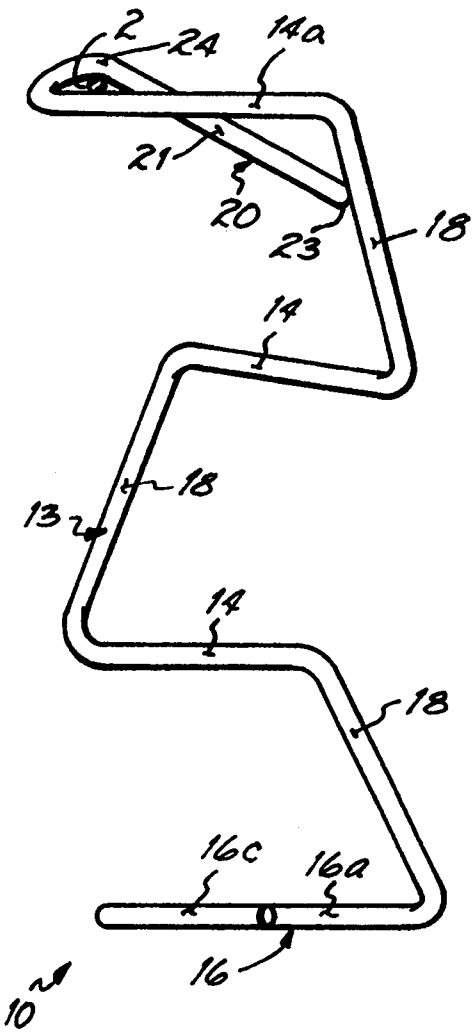
FIG. 4 is a side elevational view of the spring unit with a grid wire locked in place in the locking member of the spring unit; and, FIG. 5 is a top view of a box spring incorporating a spring assembly of the present invention and having a portion cut away to show the details of the inner spring assembly.

As best illustrated in FIG. 4, the locking bars 21, 22 and the connecting bend 23 all lie in a single plane. In addition, the locking bars 21, 22 angle downwardly such that their distal ends and the connecting bend 23 extend significantly below the uppermost torsion members **12*a*, 14*a***.

When locking the spring unit onto a grid wire 2, the locking bars 21, 22 are slid over the grid wire 2 while simultaneously the torsion bars **12*a*, 14*a* are wedged beneath the same grid wire 2, so that upper surfaces of the grid wire 2 are firmly wedged within the second pair of bends 24, 25 and the under surface of the straight grid wire 2 is wedged beneath the horizontal torsion bars 12*a*, 14*a*. See FIGS. 3 & 4**.

Figure 5:
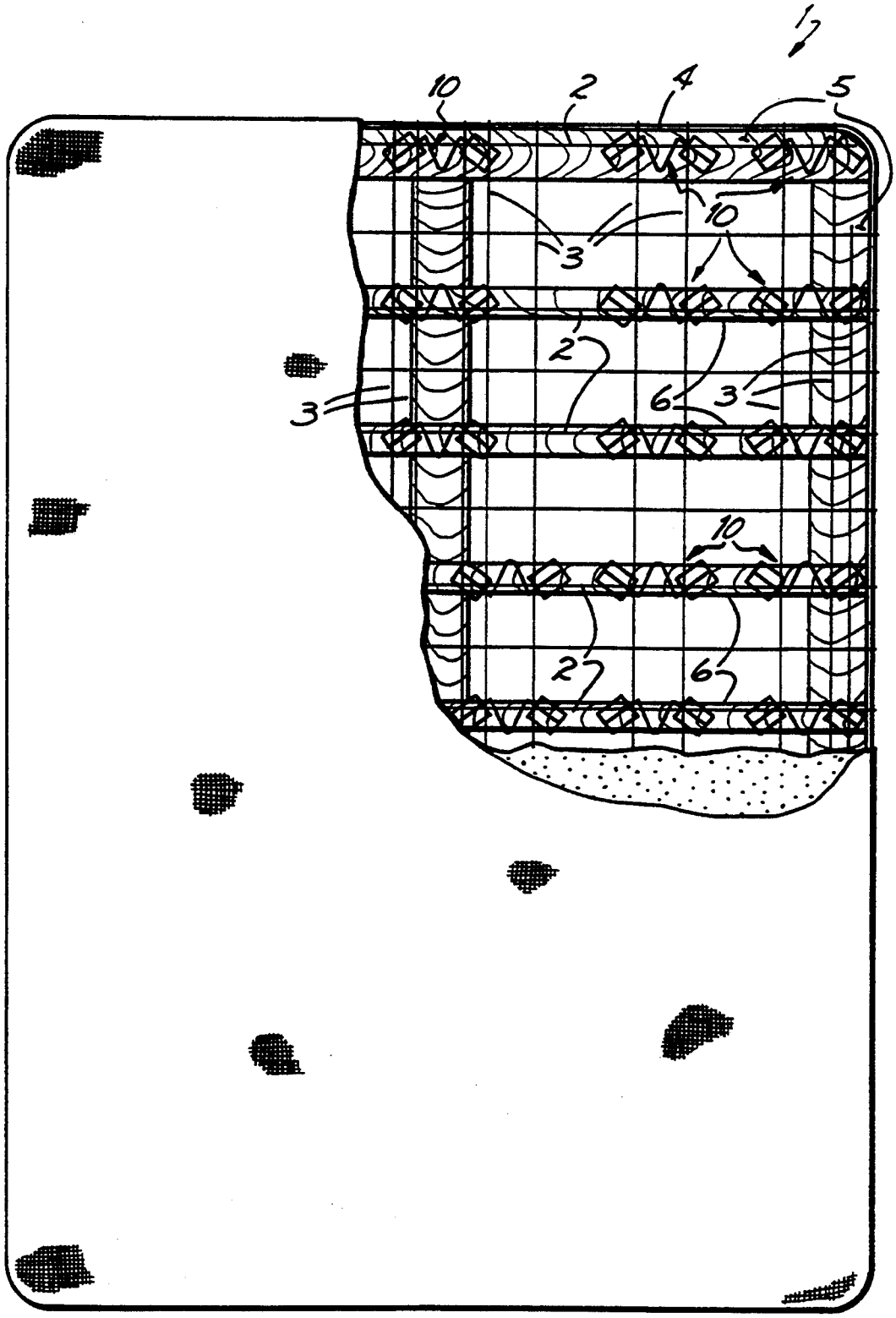

FIG. 5 shows a mattress box spring I having an outer covering which is partially cut away to show a spring assembly incorporating the spring unit 10 of the present invention. The spring assembly includes an upper wire grid support structure having a plurality of straight interconnected cross wires 2 and straight longwires 3. The cross wires 2 and longwires 3 are attached to a border wire 4 at their outer ends. As previously mentioned, the cross wires 2 and longwires 3 intersect at right angles to each other and are welded to each other at their intersections in a conventional manner. The spring assembly further includes a lower base frame conventionally constructed from outer side and end frame members 5 and inner crossbar or cross slot frame members 6 formed from wood. As one conventional configuration, the inner frame members or cross slots 6 are shown to run parallel to the cross wires 2.

A plurality of spring units 10 are shown to be attached between the lower base frame and the wire grid in one of several possible configurations. The foot portions 15, 16 of the spring units 10 are rigidly secured to the inner frame members 6 and the two outer frame members 5 that are parallel to the inner frame members 6 as shown in FIG. 1 and described above. The locking member 20 of each spring units 10 is connected to a cross wire 2 in the manner also described above. Other configurations and numbers of both the spring units 10 and inner and outer frame members 5, 6 are possible and depend on the desired physical and aesthetic characteristics of the spring assembly.

Accordingly, the present invention provides a spring unit and a spring assembly incorporating the spring unit wherein the spring unit may be locked onto a grid wire of the spring assembly without the need for separate fasteners or deviations in the grid wire. Moreover, the invention improves manufacturing efficiency and eases the assembly operations involving the module.

Although a preferred embodiment of the invention has been described above, certain modifications will become readily apparent to those of ordinary skill in the art without departing from the scope of the invention and applicant intends to be bound only by the claims appended hereto.

I claim:

1. A spring unit for connecting to a wire grid and formed integrally from a spring wire comprising:

first and second spaced foot members formed by said spring wire at a lower end of said unit and being adapted for attachment to a support surface;

first and second spring members extending upwardly from said first and second foot members, respectively, said first and second spring members each terminating in a generally horizontal uppermost portion; and, a locking member formed in said wire and interconnecting the generally horizontal uppermost portions of said first and second spring members, said locking member including a first pair of bends in said wire and first and second straight, upwardly angled portions, each bend of said first pair of bends being connected at one end to one of said uppermost portions of said spring members and at the opposite end to one of said first and second straight, upwardly angled portions of said spring wire, said first and second upwardly angled portions being connected to respective bends of a second pair of bends in said spring wire, said second pair of bends being connected to respective first and second downwardly extending straight locking bars which are connected to each other by a connecting bend at their distal ends;

wherein a wire from said wire grid is adapted to be placed beneath said locking bars and located within said second pair of bends.

2. The spring unit of claim 1 wherein said locking bars and said connecting bend lie in a single plane.

3. The spring unit of claim 2 wherein said spring members are formed by plurality of interconnected torsion members and connector members of said spring wire, said generally horizontal uppermost portions being torsion members, wherein during compression of said spring unit said torsion members experience a torsional force and said connector members experience a bending force.

4. The spring unit of claim 3 wherein and said locking bars extend below said generally horizontal uppermost portions of said spring members.

5. The spring unit of claim 4 wherein said torsion members are generally parallel to and said connector members are generally transverse to a plane defined by said wire grid when said spring unit is attached to said wire grid.

6. The spring unit of claim 5 wherein said first and second foot members each include a torsion member.

7. A spring unit for connecting to a wire grid and formed integrally from a spring wire comprising:

first and second spaced foot members formed by said spring wire at a lower end of said spring unit and being adapted for attachment to a support surface;

first and second spring members extending upwardly from said first and second foot portions, respectively, said first and second spring members each terminating in a generally horizontal upper torsion bar; and, a locking member formed in said spring wire and interconnecting the generally horizontal upper torsion bars of said first and second spring members, said locking member including first and second bend portions in said spring wire, each of said first and second bend portions being connected at one end to one of said upper torsion bars of said spring members and at an opposite end to respective first and second downwardly extending straight locking bars connected to each other by a connecting bend at their distal ends, wherein said locking bars and said connecting bend lie in a single plane and, in side elevational view, more than half of each locking bar is disposed below said generally horizontal upper torsion bars;

wherein a grid wire from said wire grid is adapted to be placed beneath said locking bars and located within said first and second bend portions.

8. The spring unit of claim 7 wherein said spring members are formed by plurality of interconnected torsion members and connector members of said spring wire, said generally horizontal upper torsion bars being torsion members, wherein during compression of said spring unit said torsion members experience a torsional force and said connector members experience a bending force.

9. The spring unit of claim 8 wherein said torsion members are generally parallel to and said connector members are generally transverse to a plane defined by said wire grid when said spring unit is attached to said wire grid.

10. The spring unit of claim 9 wherein said first and second foot members each include a torsion member.

11. A spring assembly comprising:

(a). an upper generally planar wire grid having a plurality of rectilinear grid wires crossing one another and connected at their ends to an outer grid frame to form a spring unit upper support structure;

(b). a lower generally planar base frame having connected outer frame members forming the periphery of said base frame and a plurality of inner frame members connected between said outer frame members and forming a spring unit lower support structure;

(c). a plurality of spring units each of which is formed integrally from a spring wire and connected between said upper wire grid and said lower base frame, each spring unit comprising:

(i). first and second spaced lower foot members formed at a lower end of said spring unit, each foot member being attached to an inner frame member;

(ii). first and second resilient spring members formed in said spring wire and extending upwardly from said first and second foot members, respectively, said first and second spring members each terminating in a generally horizontal uppermost portion; and, (iii). a locking member formed in said spring wire and interconnecting the generally horizontal uppermost portions of said first and second spring members, said locking member including a first pair of bends in said spring wire and first and second straight, upwardly angled portions, each bend of said first pair of bends being connected at one end to one of said uppermost portions of said spring members and at the opposite end to one of said first and second straight, upwardly angled portions of said locking member, said first and second upwardly angled portions being connected to respective bends of a second pair of bends in said spring wire, said second pair of bends being connected to respective first and second downwardly extending straight locking bars which are connected to each other by a connecting bend at their distal ends;

wherein said grid wire is located within said second pair of bends.

12. The spring assembly of claim 11 wherein said locking bars and said connecting bend lie in a single plane.

13. The spring assembly of claim 12 wherein said spring members are formed by plurality of interconnected torsion members and connector members of said spring wire, said generally horizontal uppermost portions of said spring member being torsion members, wherein during compression of said spring unit said torsion members experience a torsional force and said connector members experience a bending force.

14. The spring assembly of claim 13 wherein said locking bars extend below said generally horizontal uppermost portions of said spring members.

15. The spring assembly of claim 14 wherein said torsion members are generally parallel to and said connector members are generally transverse to a plane defined by said wire grid.

16. The spring assembly of claim 15 wherein said first and second foot members each include a torsion member.

17. A spring assembly comprising:

(a) an upper generally planar wire grid having a plurality of rectilinear grid wires crossing one another and connected at their ends to an outer grid frame to form a spring unit upper support structure;

(b) a lower generally planar base frame having connected outer frame members forming the periphery of said base frame and a plurality of inner frame members connected between said outer frame members and forming a spring unit lower support structure;

(c) a plurality of spring units each of which is formed integrally from a spring wire and connected between said upper wire grid frame and said lower base frame, each spring unit comprising:

(i) first and second spaced lower foot members formed at a lower end of said spring unit, each foot member being attached to an inner frame member;

(ii) first and second spring members formed in said spring wire and extending upwardly from said first and second foot members, respectively, said first and second spring members each terminating in a generally horizontal upper torsion bar; and, (iii) an upper locking member formed in said spring wire and interconnecting the generally horizontal upper torsion bars of said first and second spring members, said locking member including first and second bend portions in said spring wire, each of said first and second bend portions being connected at one end to one of said generally horizontal upper torsion bars of said spring members and at the opposite end to respective first and second downwardly extending locking bars connected to each other by a connecting bend at their distal ends, wherein said locking bars and said connecting bend lie in a single plane and, in side elevational view, more than half of each locking bar is disposed below said generally horizontal upper torsion bars;

wherein said grid wire is located within said first and second bend portions.

18. The spring assembly of claim 17 wherein said spring members are formed by plurality of interconnected torsion members and connector members of said spring wire, said generally horizontal upper torsion bars being torsion members, wherein during compression of said spring unit said torsion members experience a torsional force and said connector members experience a bending force.

19. The spring assembly of claim 18 wherein said torsion members are generally parallel to and said connector members are generally transverse to a plane defined by said wire grid.

20. The spring assembly of claim 19 wherein said first and second foot members each include a torsion member.

* * * * *